United States Patent [19]

MacElvain et al.

[11] 4,098,466

[45] Jul. 4, 1978

[54] IMPACT MILL FOR REDUCING SOLIDS

[76] Inventors: Robert C. MacElvain; Ford M. MacElvain, both of 3009 Lafayette Pkwy., Opelika, Ala. 36801

[21] Appl. No.: 760,000

[22] Filed: Jan. 17, 1977

Related U.S. Application Data

[63] Continuation-in-part of Ser. No. 554,596, Mar. 3, 1975, abandoned.

[51] Int. Cl.[2] ..... B02C 13/09

[52] U.S. Cl. ..... 241/57; 241/189 R; 241/191; 241/275; 241/292

[58] Field of Search ..... 241/40, 47, 57, 58, 241/189 R, 191, 275, 292

[56] References Cited

U.S. PATENT DOCUMENTS

| | | | |
|---|---|---|---|
| 197,023 | 11/1877 | Ent | 241/292 |
| 279,067 | 6/1883 | Wolf | 241/47 |
| 1,188,323 | 6/1916 | Richardson | 241/57 |
| 2,373,691 | 4/1945 | Kessler | 241/189 R X |
| 2,618,438 | 11/1952 | Chrystal | 241/189 R X |
| 3,141,485 | 7/1964 | Bonner, Jr. et al. | 241/292 X |
| 3,455,517 | 7/1969 | Gilbert | 241/189 R |
| 3,701,485 | 10/1972 | Kimble et al. | 241/189 R X |

OTHER PUBLICATIONS

Impact Mill Designed in Australia; in Mining and Chemical Engineering Review, 15 Dec. 1964, p. 15.

*Primary Examiner*—Roy Lake
*Assistant Examiner*—Howard N. Goldberg
*Attorney, Agent, or Firm*—Newton, Hopkins & Ormsby

[57] ABSTRACT

Ore, rock or other solids are reduced to a predetermined aggregate size with minimum energy consumption and maximum efficiency and with a dramatically reduced wear factor on machinery compared to traditional ball mills and hammer mills. A relatively low speed impact rotor propells gravitating solids continuously on a zigzag path between moving rotor bars and opposing stationary impact plates in an array surrounding the impact rotor. Easily replaceable low carbon steel impact parts may be employed. The avoidance of sliding contact between solids and metal machinery parts minimizes wear. An optional positive air draft arrangement allows the collection of fines and dust outside of the impact chamber.

10 Claims, 6 Drawing Figures

IMPACT MILL FOR REDUCING SOLIDS

CROSS-REFERENCE TO RELATED APPLICATION

This application is a continuation-in-part of prior copending application Ser. No. 554,596, filed Mar. 3, 1975, for SOLID OBJECT REDUCING APPARATUS, now abandoned.

BACKGROUND OF THE INVENTION

The invention arises as a result of a need in the art for a less complex and more wear-resistant solids reducing apparatus or mill which will operate with reduced consumption of energy compared to traditional mills including ball mills, hammer mills and the like. In the prior art, solids reducing devices, rapid wear of metal parts frequently occurs due to the fact that sliding contact of the parts with solids produces rapid abrasion of metal surfaces. The parts subjected to this wear must be frequently replaced or, to avoid this, high carbon steel or other comparably expensive materials must be used in the mills. Either way, the economics of the situation is unsatisfactory. Some examples of the known patented prior art are U.S. Pat. Nos. 3,455,517; 3,612,415 and 3,782,643.

The general objective of the present invention is to satisfy the above-stated need of the art by providing a simplified and comparatively inexpensive solids reducing apparatus which is constructed and operated in such a manner that all sliding contact between the solids and the metal elements which reduce the solids is virtually eliminated. Instead, the solids are fractured and reduced entirely by impact against coacting stationary and rotating reducing components and also by impact with other solids in the impact chamber of the apparatus. In effect, solids being reduced while gravitating into and through the impact chamber in a controlled manner are struck by a rotating hammer means and rebounded back and forth in a more-or-less zigzag path between moving hammer bars and stationary impact plates in an array surrounding the rotating hammer means. Abrading of the solids reducing elements is almost eliminated and low carbon steel may be employed for the impact elements. The wear ratio compared to conventional ball mills and hammer mills is about 1 to 10.

Almost the total energy consumed by the apparatus or mill is utilized in reducing the ore or other solids instead of being consumed as in the prior art in overcoming inertia of swinging impact members and in creating friction due to sliding contact of solids with crushing or other forms of disintegrating members.

In the invention, the stationary impact plates which surround the impact rotor are positioned relative to each other so that aggregates of the required size will gravitate from the impact chamber only after sufficient reduction of solids has occurred. The necessity for more complex adjustable discharge means is eliminated.

The apparatus is constructed so that impact elements on the rotor and in the stationary surrounding array are individually removable and replaceable at the exterior of the apparatus.

Another important feature of the invention is that the pure impact reduction system allows a comparatively slow rotor speed, such as 750 rpm in a large machine. This rotational speed will provide about 90 mph velocity for the tip of the rotor and propelled solids particles will attain speeds of 200–400 mph at times in the reduction or impact chamber. In effect, a fluidized bed of solids is created in the apparatus in which the particles impinge on themselves while rebounding back and forth between the rotor hammer bars and stationary surrounding impact plates. This operation is extremely efficient in reducing the solids to proper aggregate size in the minimum time with minimum energy consumed and minimum wear on the apparatus.

An optional forced air system constitutes a further feature of the invention by means of which a draft is induced through a collection chamber for fines and dust. With or without this feature, the larger aggregates gravitate through a funnel-like discharge means at the bottom of the main reducing chamber.

Other features and advantages of the invention will become apparent during the course of the following description.

DETAILED DESCRIPTION

Figure 1:
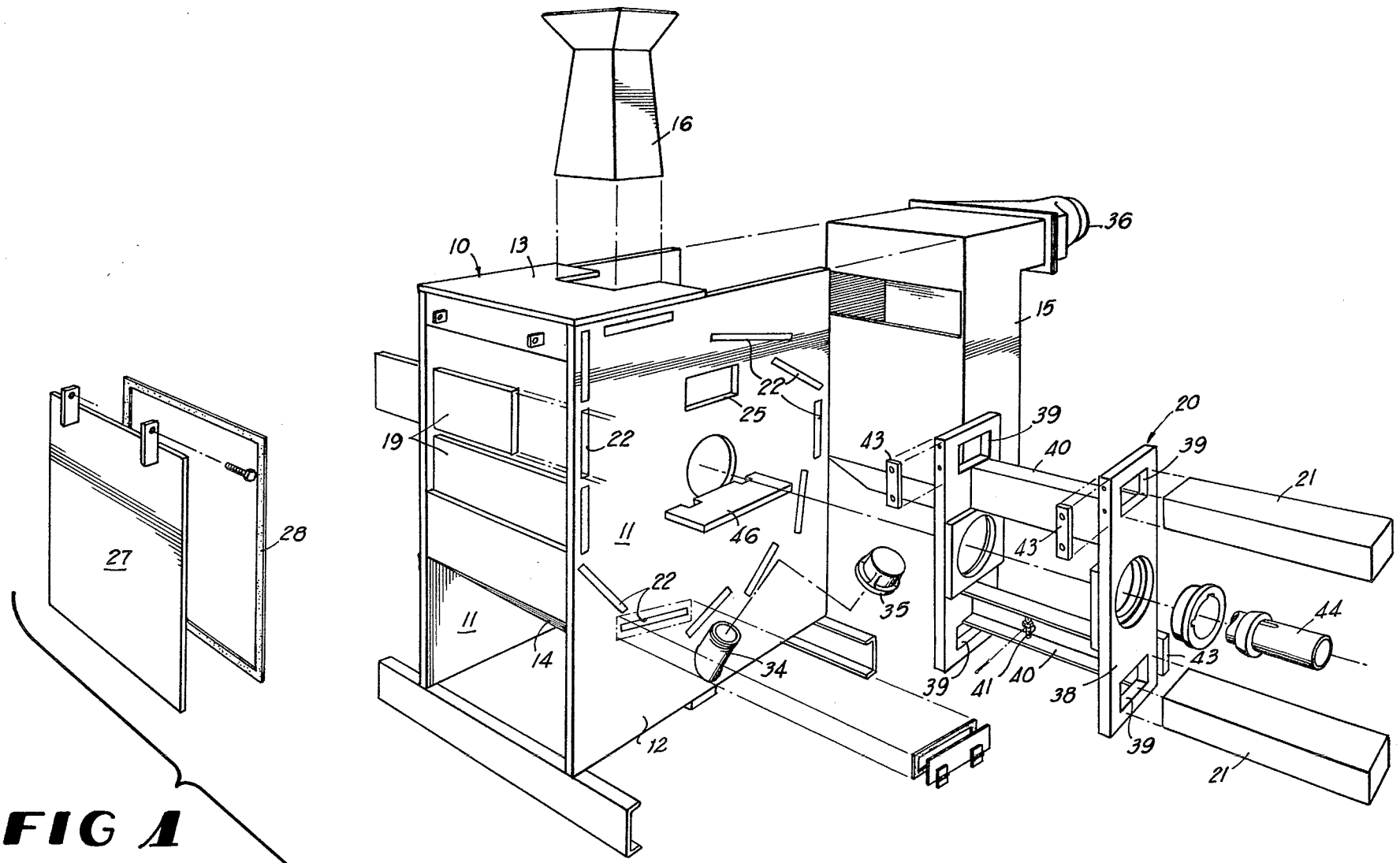
FIG. 1 is an exploded perspective view of the invention with some parts omitted.
Figure 2:
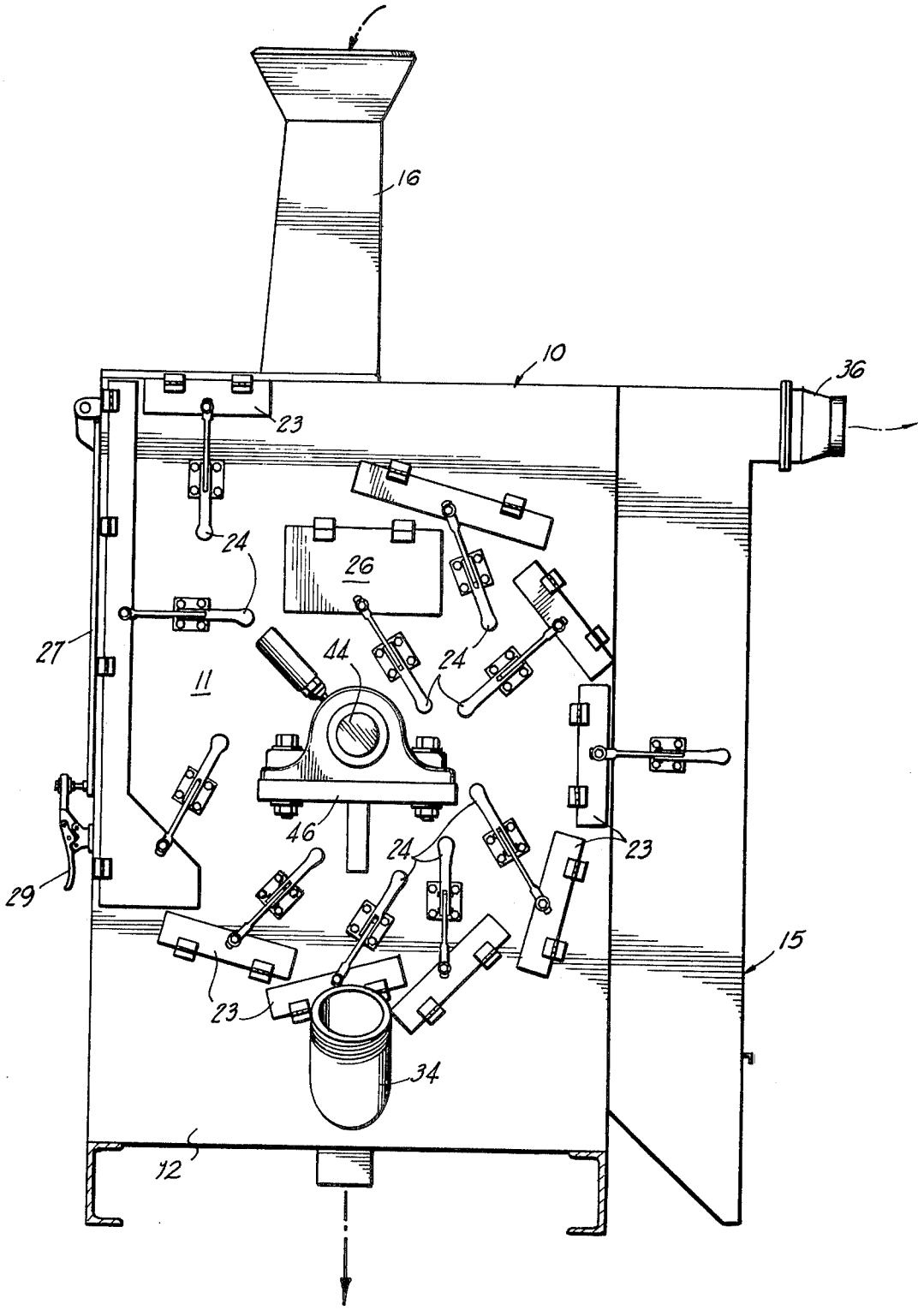
FIG. 2 is a side elevational view of the assembled invention looking along the rotor axis.

Referring to the drawings in detail wherein like numerals designate like parts, the numeral 10 designates a main housing or body portion for the solids reducing apparatus including side walls 11 and 12, a partial top wall 13 and a hopper-like aggregates discharge bottom 14.

At one narrow side of the main housing 10, a collection chamber 15 for fines and dust is provided and, in some cases, this feature could be omitted. It will be further described. The chamber 15 is attached to the main housing walls in any conventional manner, the details of which attaching are not important.

Figure 6:
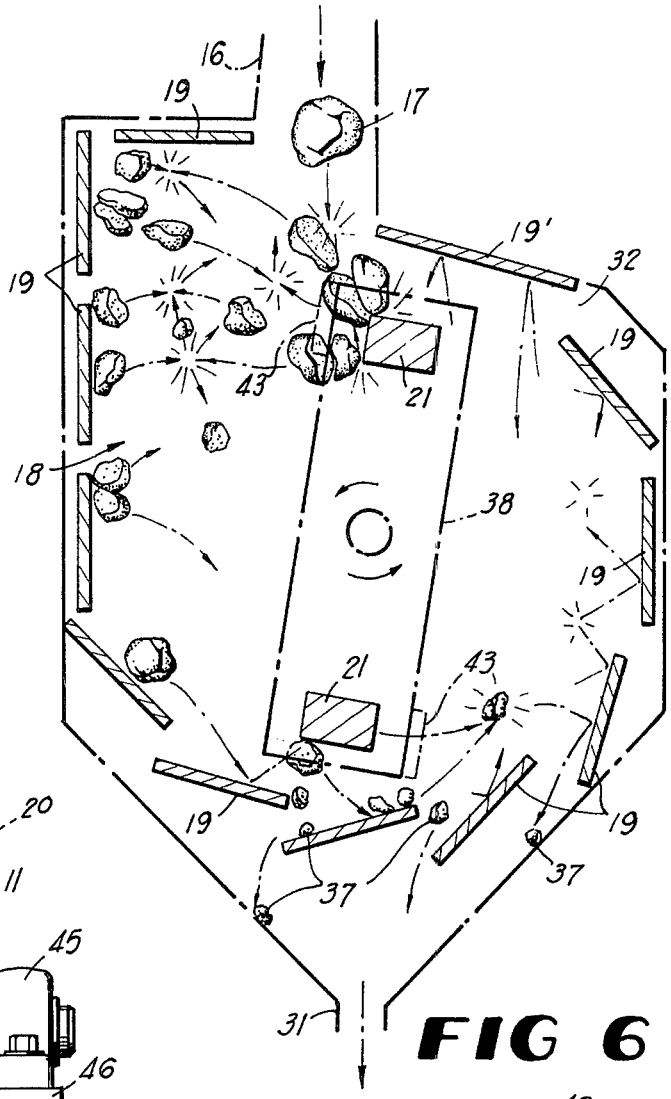
FIG. 6 is a partly diagrammatic section, similar to FIG. 3, taken through the impact reduction chamber and illustrating the operation of the invention in reducing solids purely by impact and without significant sliding engagement with apparatus parts.
Figure 5:
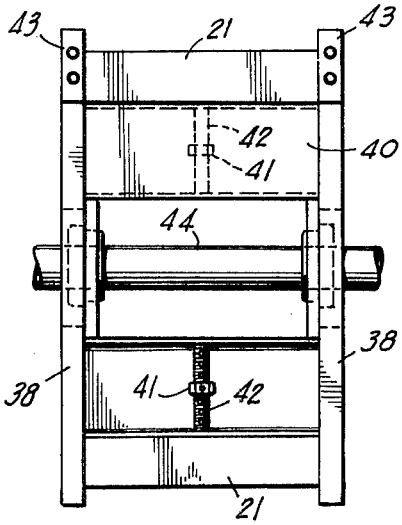
FIG. 5 is a side elevational view of the impact rotor or hammer assembly.

The apparatus or mill further involves a gravity inlet chute 16 for unreduced solids at the top of the housing 10 and the side walls of this chute diverge somewhat downwardly as shown to promote free falling of unreduced solids 17, FIG. 6, into the impact solids reducing chamber 18 of the apparatus.

The impact chamber 18 within the main housing 10 is rigidly defined by an array of preferably steel flat impact slats or plates 19 which surround a large horizontal axis impact rotor assembly 20 forming another major component of the invention. Because of the dramatically reduced wear ratio compared to the prior art, the flat impact plates 19 and the heavy impact bars 21 of the rotor 20 can be formed of inexpensive low carbon steel for economy. Nevertheless, these parts are made easily removable and replaceable in the apparatus, as will now be described.

The flat impact plates 19 which are elongated and rectangular are received through and supported in slots 22, FIG. 1, in the housing side walls 11. The plates 19 are easily withdrawn through these slots when replacement is necessary without the necessity for disturbing other components of the apparatus. Hinged gasketed access doors 23 on the side walls 11 equipped with over-dead-center locking levers 24 are provided for further convenience and security. Similarly, the rotor impact bars 21 are removed and inserted endwise through somewhat larger side wall openings 25 in the housing 10 covered by a gasketed hinged access door 26. A main access door 27 of considerable size having a gasket 28 and locking levers 29 is provided on the front of the housing 10 so that the rotor 20 can be balanced or otherwise serviced without removing it from the housing. When the apparatus is assembled, the rotor assembly 20 is introduced into the housing 10 through the large access door 27.

Figure 3:
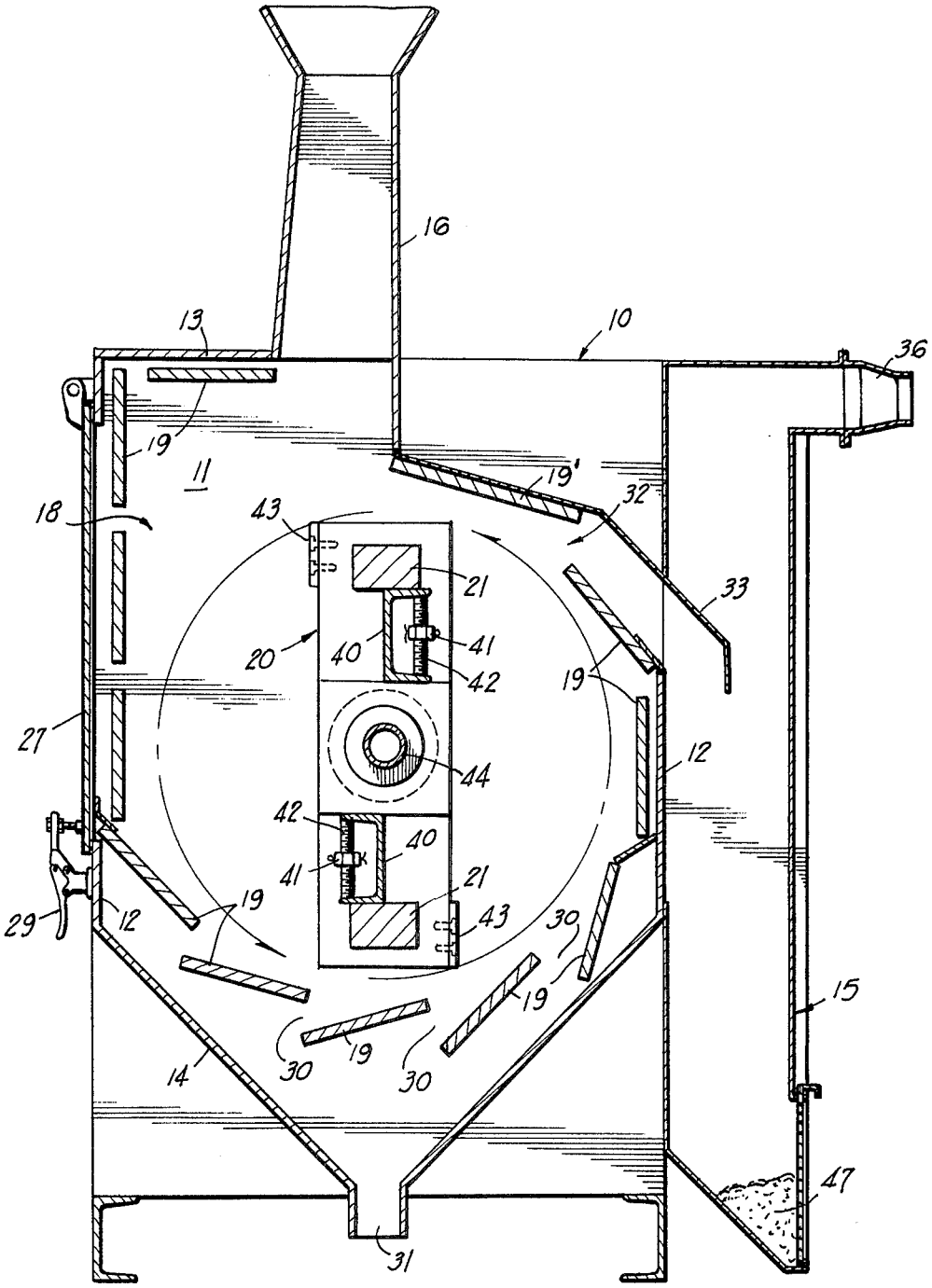
FIG. 3 is a central vertical section through the apparatus.
Figure 4:
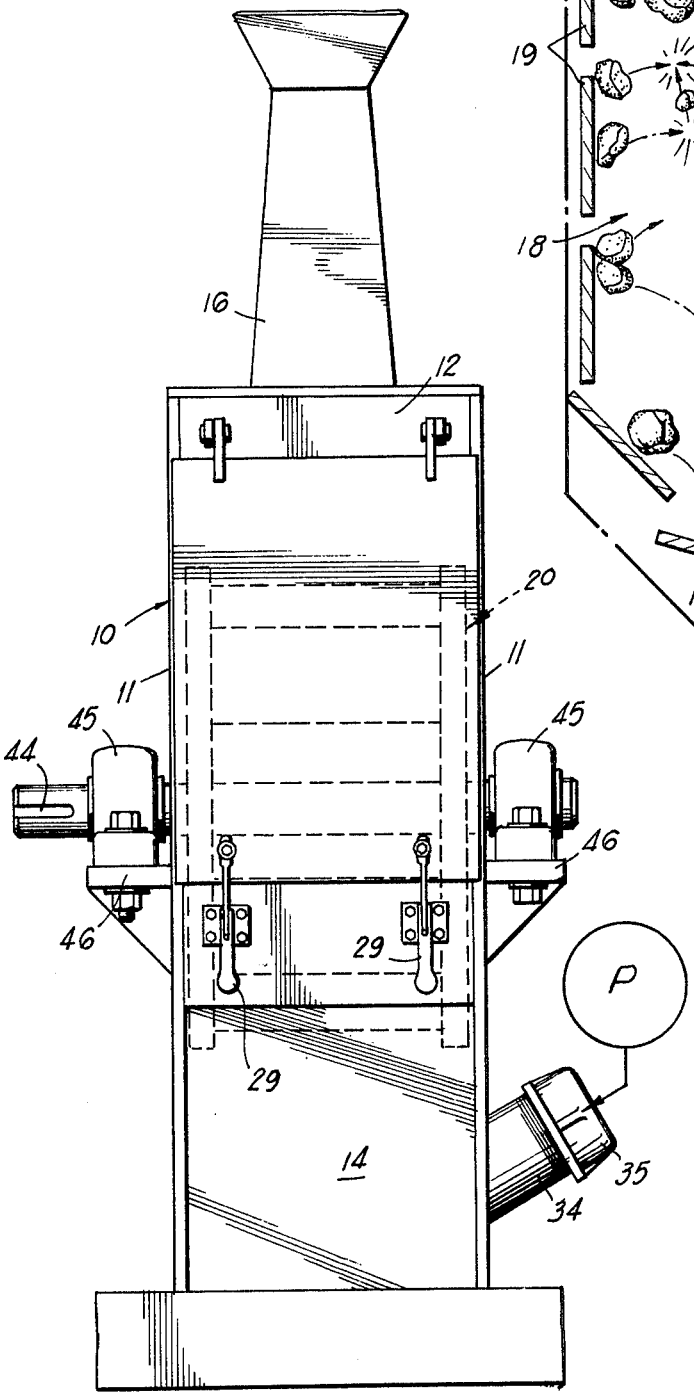
FIG. 4 is an elevational view taken at right angles to FIG. 2.

It can be seen in FIGS. 3 and 6 that the impact reduction chamber 18 defined by the spaced plates 19 completely surrounds the impact rotor and extends from the bottom of solids inlet chute 16 counterclockwise around the rotor and back to a point somewhat below the bottom of the chute 16, as defined by a relatively large, slightly inclined impact plate 19'. The topmost plate 19, FIG. 3, is horizontal and the adjacent three side impact plates close to the door 27 are vertical as is the far side plate 19 adjacent the fines chamber 15. The remaining impact plates of the generally circumferential array are inclined varying degrees, as illustrated, so that the rotor may pass their inner faces with sufficient clearance to avoid wedging or jamming of solids between the rotor assembly and the stationary plates. At the bottom of the chamber 18, the passages 30 between the lowermost impact plates 19 serve as outlets for the reduced aggregate allowing it to funnel through the extension 31 to a suitable collection point. A similar passage or outlet 32 immediately below the plate 19' allows for the passage of fines and dust from the chamber 18 to the interior of collection chamber 15 when the positive air draft system is utilized, as will be further described.

To provide a positive draft through the outlet passage 32 and under a shroud 33 into the chamber 15, a suitable conduit, not shown, leading from a blower can be coupled to a short pipe 34 on one of the side walls 11 near the bottom of the chamber 18 and opening into the reducing chamber. A cap 35 for the pipe 34 is provided to close the pipe when the draft system is not utilized, in which case the fines and dust will not tend to enter the collection chamber 15 but will simply gravitate from the bottom of the main chamber 18 along with larger aggregate. A vent 36 at the top of fines collecting chamber 15 may be valved or restricted to control the escape of air so that dust will not be lost to the atmosphere.

In connection with the discharge of reduced aggregate 37, FIG. 6, through the passages 30, this discharge will not occur until the larger solids have been reduced by impact to the predetermined required size for which the placement of the plates 19 are arranged to achieve. Until this degree of solids reduction is obtained, the apparatus or mill will simply continue to act on and reduce the large solids introduced into the chamber 18. It may be mentioned here that a controlled introduction of solids 17 through the chute 16 is desirable to promote a fluidized mass or bed in the chamber 18 of correct density. Otherwise, the reducing chamber 18 could become clogged and the solids could be jammed by the rotor against the plates 19 with sliding and abrading action to defeat the purpose of the invention. With a little experience and observation, an even and correct flow of material into the mill can be established and maintained and continuous efficient and uniform reduction of ore or the like can easily be achieved with minimum power consumption and minimal wear on impact parts.

The impact rotor assembly 20, previously mentioned, comprises spaced parallel end plates 38 having rectangular openings 39 near their opposite ends to receive the replaceable impact bars 21. The plates 38 are rigidly joined by a pair of channel members 40 whose open sides face in opposite directions on the rotor. The channel members 40 are spaced equidistantly radially from the rotational axis of the rotor 20 with their main webs lying in a common plane with this axis, as best shown in FIG. 3.

Means are provided to accurately balance the impact rotor 20 in the form of a pair of adjustable and lockable balancing nuts 41 engaged with threaded studs 42 fixed to the channel members 40 preferably at their longitudinal centers. Replaceable sacrificial wear plates 43 are preferably provided on the edges of the end plates 38 which impact with solids during the operation of the mill. This is simply a means to absorb wear at the localized areas on the plates 38 where the greatest contact with solids occurs. Sacrificial wear surfaces may be eliminated if the side plates are constructed in a circular geometry.

As best shown in FIG. 3, the impact bars 21 are symmetrically arranged relative to the axis of rotor 20 and lie adjacent to the outer webs of channel members 40.

The impact rotor 20 is secured to a rotational drive shaft 44 adapted to be driven by a suitable drive means, not shown, external to the housing 10. The rotor drive shaft 44 is journaled in a pair of sturdy bearings 45 immediately outside of the side walls 11 and mounted on bearing rests 46 fixedly secured to the side walls 11. The details of attachment of the rotor assembly 20 to the shaft 44 are conventional and need not be further described.

SUMMARY OF OPERATION

With the impact rotor 20 turning in the direction of the arrows, FIG. 6, ore or other solids components 17 are introduced in a controlled manner through the chute 16 and into the reducing chamber 18 in a free-fall mode. Care is exercised not to overload the chamber 18. At the top of the chamber 18 the solids are struck repeatedly by the impact bars 21 of the rotor 20 which may be revolving at a speed of about 750 rpm. The struck solids are projected away from the rotor 20 and are caused to impact against the various plates 19 beginning at the upper left hand corner, FIG. 6, and progressing around the reducing chamber 18 in a counterclockwise direction. The solids components are fractured as a result of collision with the plates 19 and bars 21 repeatedly during the operation of the apparatus. Reduction of the solids is also achieved by collision or impact with other solids particles in the chamber 18 during the process. Generally, the impacted solids tend to rebound back and forth in a zigzag path between the rotating bars 20 and the plates 19 progressively from the top of the chamber 18 downwardly toward the lowermost plates 19 of the array of impact plates.

The process continues until the solids are sufficiently reduced in size as at 37 to pass through the spaces between the lower angled plates 19, and these reduced solids then gravitate through the outlet 31 to a collection point.

When the described forced air system is employed through the pipe 34, fines and dust will be elevated by the induced air draft at the right hand side of the chamber 18, FIGS. 3 and 6, and will be drawn through the passage 32 and under the shroud 33 to the collection chamber 15 at one side of the apparatus. The collected fines and dust will gravitate into the lower part of chamber 15 as shown at 47. Air delivered to the chamber 15 is exhausted to atmosphere through the outlet 36 which is conventionally filtered and valved.

The solids reduction process is continuous and rapid and quite efficient. Practically all of the energy employed to drive the rotor 20 is utilized in reducing the material by impact, as described, and this operation requires much less energy compared to mills which grind, crush or abrade solids against wear surfaces. Since the present process involves almost pure impact and virtually no abrasive sliding action of solids and metal surfaces in the apparatus, the wear ratio compared to the prior art is dramatically reduced, as previously noted.

The components of the apparatus which do continuously receive the impact forces are made easily replaceable, as described, and easy to inspect individually, when desired, without disturbing other apparatus components.

The many advantages of the invention should now be apparent to those skilled in the art.

It is to be understood that the form of the invention herewith shown and described is to be taken as a preferred example of the same, and that various changes in the shape, size and arrangement of parts may be resorted to, without departing from the spirit of the invention or scope of the subjoined claims.

We claim:

1. An apparatus for reducing solids by impact comprising means forming a reduction chamber having a top inlet for solids and a bottom outlet for reducing solids, an impact rotor in the chamber and spanning the chamber substantially between opposing side walls of the chamber, a generally circumferential array of fixed impact members in said reduction chamber near the periphery thereof, said impact members having generally flat surfaces facing generally in directions toward said rotor, at least the lowermost impact members being below said rotor and near said bottom outlet and spaced apart to form reduced solids discharge passages, the impact rotor including at least a pair of impact bars spaced from the rotational axis of said rotor and revolving inwardly of said fixed impact members, said fixed impact members being so arranged circumferentially about said rotor that an annular space is provided between said fixed impact members and the path of travel of said impact bars whereby solids introduced by gravity into the top of the reduction chamber will be struck by the impact bars of the rotor and propelled against the fixed impact members and be directed back toward the part of said impact bars by said impact members and against other solids continually and progressively throughout said annular space surrounding said rotor and its impact bars in the reduction chamber from the top to the bottom thereof, until said solids are reduced in size enough to pass through said discharge passages.

2. An apparatus for reducing solids by impact as defined in claim 1, and said fixed impact members comprising substantially flat rectangular plate members arranged at varying angles around the circumference of said reduction chamber and extending between said opposing side walls of said chamber.

3. An apparatus for reducing solids by impact as defined in claim 2, and said flat plate members in said array including a plurality of substantially vertical plate members at one side of the reduction chamber, the remaining plate members of said array angled progressively around the circumference of the reduction chamber to be roughly tangential to the circular peripheral path of movement of said impact rotor.

4. An apparatus for reducing solids by impact as defined in claim 2, and said opposing side walls having slots therein for the support of said flat plate members and through which the plate members may be passed slidably for mounting in said chamber or removal therefrom.

5. An apparatus for reducing solids by impact as defined in claim 4, and latchable gasketed closure elements on said opposing side walls adapted to cover said slots and retaining said flat plate members in their use positions in said reduction chamber.

6. An apparatus for reducing solids by impact as defined in claim 1, and said impact bars being massive rectangular cross section bars symmetrically disposed relative to the axis of said rotor and passing near the fixed impact members during rotation.

7. An apparatus for reducing solids by impact as defined in claim 6, and dynamic balance adjusting means on said rotor, said adjusting means including a threaded stud carried by said rotor and a lockable nut on said stud.

8. An apparatus for reducing solids by impact as defined in claim 1, and means connected with said reduction chamber to induce an air draft therethrough, a fines collection chamber outside of said reduction chamber and connected with the latter by a passage near the top of the reduction chamber through which an air draft may travel from the reduction chamber into said fines collection chamber, said means to induce an air draft including an air exhaust outlet in the upper portion of said fines collection chamber and means for deflecting the fines in the air stream toward the bottom of said fines collection chamber.

9. An apparatus for reducing solids by impact as defined in claim 8, and said fines collection chamber disposed at one side of said reduction chamber and being vertically elongated and having a bottom fines collection portion, and a door for said collection portion.

10. An apparatus for reducing solids by impact as defined in claim 1, and said means forming said reduction chamber comprising a generally rectangular housing having a tapered hopper-like bottom below said lowermost impact members, and said top inlet for solids comprising an upstanding chute having downwardly divergent side walls and said chute opening into the top of said reduction chamber above said impact rotor.

* * * * *